US005407723A

United States Patent [19]

Curtin

[11] Patent Number: 5,407,723

[45] Date of Patent: Apr. 18, 1995

[54] COMBINATION COVER FOR GOLF CLUB BAGS AND TOWEL

[76] Inventor: James J. Curtin, 100 Pierce St., Apt. 804, Clearwater, Fla. 34616

[21] Appl. No.: 117,472

[22] Filed: Sep. 7, 1993

[51] Int. Cl.[6] ..... B32B 9/00

[52] U.S. Cl. ..... 428/124; 428/81; 428/82; 428/99; 428/102; 428/127; 206/315.3; 206/315.4; 150/154; 150/159

[58] Field of Search ..... 428/81, 82, 99, 100, 428/102, 124, 127; 150/159, 154; 206/315.3, 315.4

[56] References Cited

U.S. PATENT DOCUMENTS 5,099,897 3/1992 Curtin ..... 150/159
5,220,950 6/1993 Cordasco ..... 150/159

*Primary Examiner*—Patrick J. Ryan
*Assistant Examiner*—Abraham Bahta
*Attorney, Agent, or Firm*—Joseph C. Mason, Jr.; Ronald E. Smith

[57] ABSTRACT

A combination towel and cover for a golf club bag. The device is a flat, foldable material having a water repellant side and a water absorbing towel side. Fastening members are positioned along selected peripheral edges of the device to hold it in a folded configuration. When fully folded, it is attachable by a clamp to a golf club bag. When unfolded, it is attachable by snapping the fastening members onto the snaps built into golf club bags such that its towel side is exposed for use. When so disposed, it may be flipped over the clubs to protect them during inclement weather, but the golfer may still reach under the device to use its towel side even when it has been flipped over. Preselected edges of the towel part of the device are unattached to the water repellant side to facilitate placing hands to be dried on opposite sides of the towel.

4 Claims, 4 Drawing Sheets

COMBINATION COVER FOR GOLF CLUB BAGS AND TOWEL

BACKGROUND OF THE INVENTION

1. Field of the invention

This invention relates, generally, to accessories attachable to golf club bags. More particularly, it relates to a flat, foldable member formed of sheet material having a water repellant first surface and a second surface that includes a towel.

2. Description of the prior art

Golf club bags are of course open ended and thus the open end must be closed when precipitation occurs if the clubs and the inside of the bag are to be protected. Bag manufacturers provide a hood for such use, but most golfers simply stuff that hood into the bag when the weather is fair; thus, the hood is difficult to retrieve when needed.

Golf club bags do not come equipped with towels, however. On any golf course at any time, nearly every golf bag on the course will have a towel attached thereto by some means rigged up by the golfer because towels are very handy on a golf course, especially if the course is wet.

Accordingly, inventors have developed accessory items in the form of combination hoods and towels. For example, a reversible hood is shown in U.S. Pat. No. 4,498,579 to Brick. A first side of the hood is formed of a water repellant material and a second side thereof is formed of a towel-like material. The device, when not in use as a hood, is releasably attachable to the golf club bag in its reversed configuration, i.e., with its towel side out. When in use as a hood, the water-repellant side is out and the towel side becomes inaccessible. Thus, the Brick device is usable as a hood or as a towel, but it cannot be used as a towel when it is being used as a hood, i.e., the conversion into a hood deletes the towel function. Since a towel is most needed during light drizzles, the loss of the towel function during such times represents a significant limitation.

The earlier devices also lack storage means for personal items that the golfer may not want to carry in his or her pockets.

An earlier invention by the present inventor, shown in U.S. Pat. No. 5,099,897, overcomes many of the limitations of the earlier designs. However, the towel side is somewhat difficult to use because the golfer must rub his or her hands against the single exposed surface thereof, and the device includes no storage means for personal items.

Thus, there is a need for a combination hood and towel that retains its towel function when in its hood configuration, and there is a need for a construction that enables the towel to be used in a substantially unrestricted way. Moreover, there is a need for a structure that provides a storage means for the convenience of the golfer.

The prior art, considered as a whole, neither teaches nor suggests to those of ordinary skill in this art how such a desirable combination device could be provided, as evidenced by the collective failure of earlier workers in this field to produce the novel construction disclosed hereinafter.

SUMMARY OF THE INVENTION

The longstanding but heretofore unfulfilled need for a combination hood and towel for golf club bags that retains its utility as a towel when being used as a hood and having a towel side that is convenient to use, and having a personal items storage means is now provided in the form of a unique device that is partially folded and releasably secured to a golf club bag when being used as a towel and that is unfolded when being used to cover the golf bag during precipitation. When used as a cover, a water repellant side thereof protects the clubs and the inside of the bag from the elements, but the golfer may still reach under the device to use the towel side thereof when needed. Significantly, preselected edges of the towel are not attached to the water-repelling side so that the golfer may place his or her hands on opposite sides of the towel to facilitate drying in the well known way. Thus, the towel function is not lost when the device is in its club-covering configuration. A novel storage means for personal items is also provided.

Thus it is understood that the primary object of this invention is to provide a combination golf club cover and towel that performs both a hood function and an unrestricted towel function at the same time.

Another object is to provide a storage means as an integral part of such combination device.

Additional objects, features and advantages of the invention will become apparent as this description proceeds.

The invention accordingly comprises the features of construction, combination of elements and arrangement of parts that will be exemplified in the construction set forth hereinafter and the scope of the invention will be set forth in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
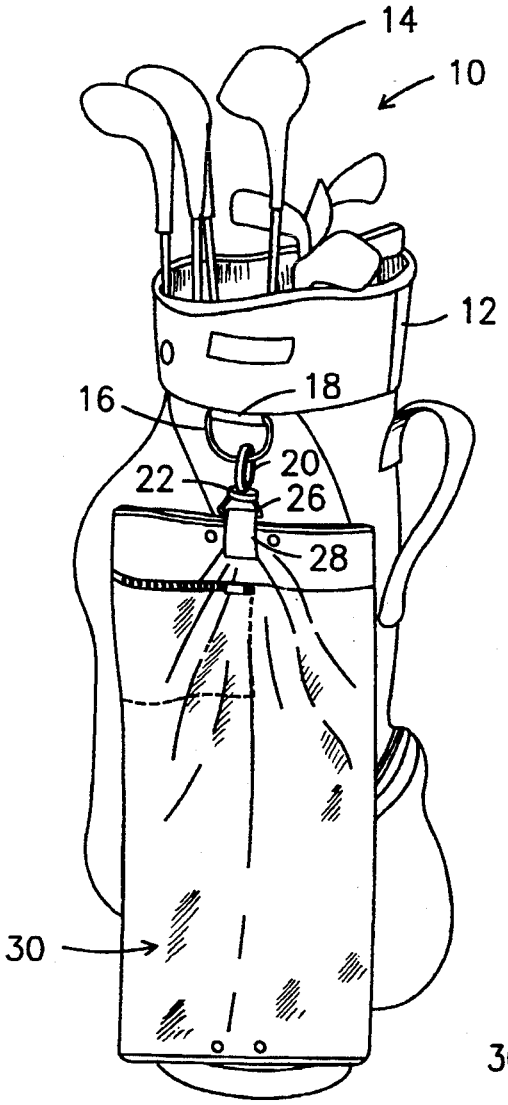
FIG. 1 is a perspective view of the novel device when partially unfolded and releasably attached to a golf club bag.

The novel device and its environment are denoted as a whole in FIG. 1 by the reference numeral 10. The device alone is denoted 30. Golf bag 12 holds clubs 14 and is of conventional construction. It includes a "D"-shaped ring 16 having its straight part captured within sleeve 18 as depicted. Many golfers extend a towel through this ring 16. The present invention includes a split clamp member 20 that releasably engages D-ring 16. Base 22 of clamp 20 is held against rotation by a pin having its opposite ends held by clevis 26 and the straight part of the clevis is captured in a sleeve formed by a loop of material 28. Clamp 20 is rotatable relative to base 22, i.e., clamp 20 is a swivel clamp.

Figure 2:
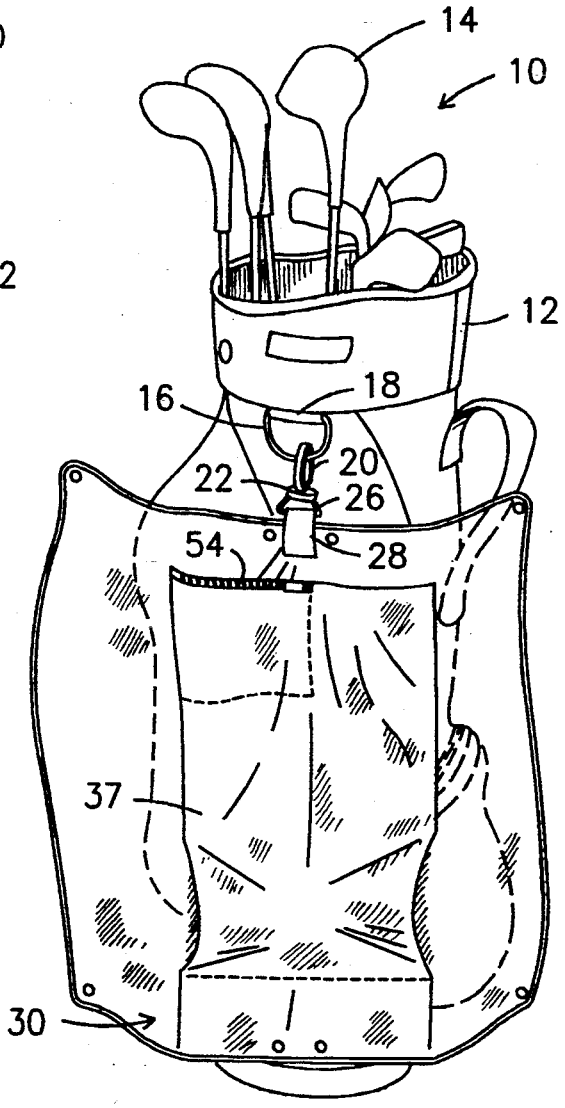
FIG. 2 is a perspective view of the device when fully unfolded and snapped onto a golf club bag, preparatory to disposing it over the open end of the golf bag.
Figure 4:
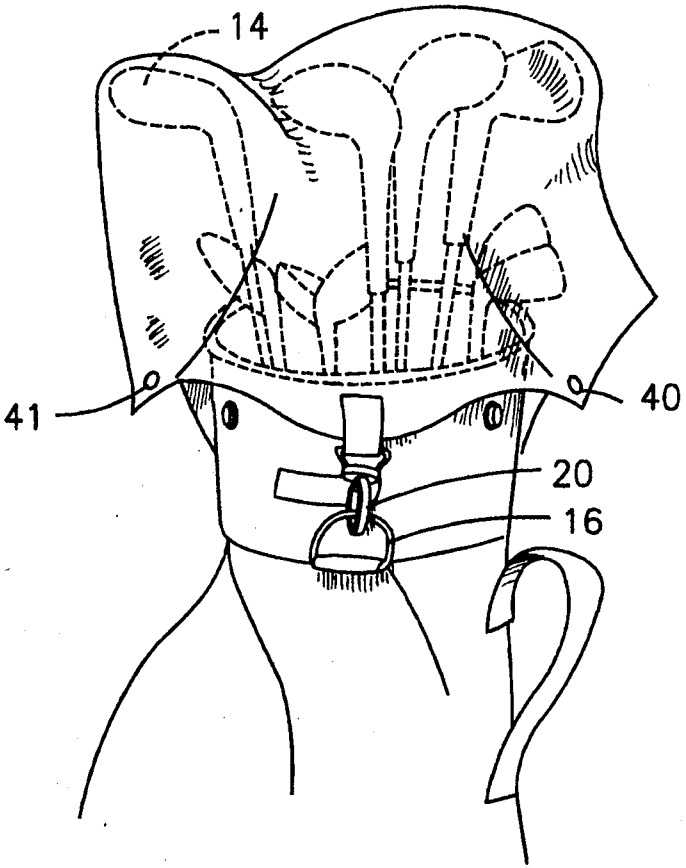
FIG. 4 is a perspective view taken from the opposite side of the view in FIG. 3.
Figure 3:
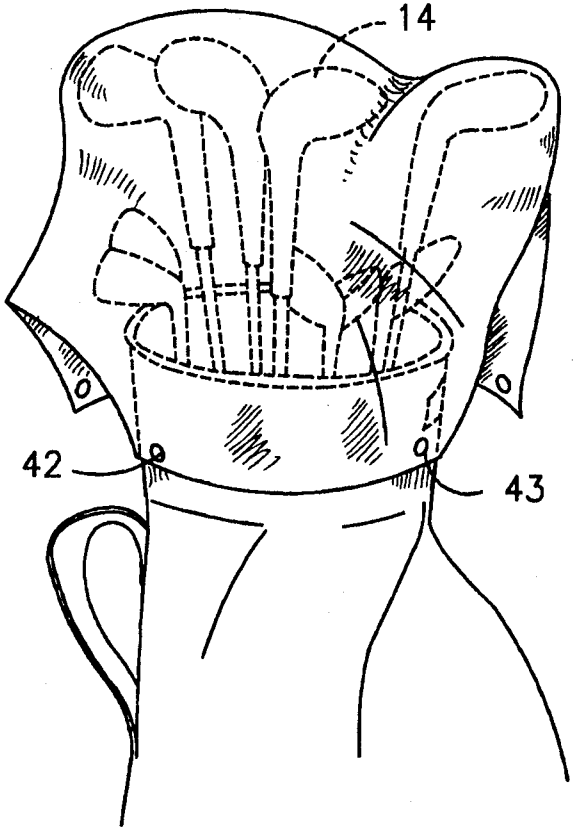
FIG. 3 is a perspective view of the device with the water repellant side exposed to the elements and the towel side being protected from the elements but accessible to the golfer.
Figure 5:
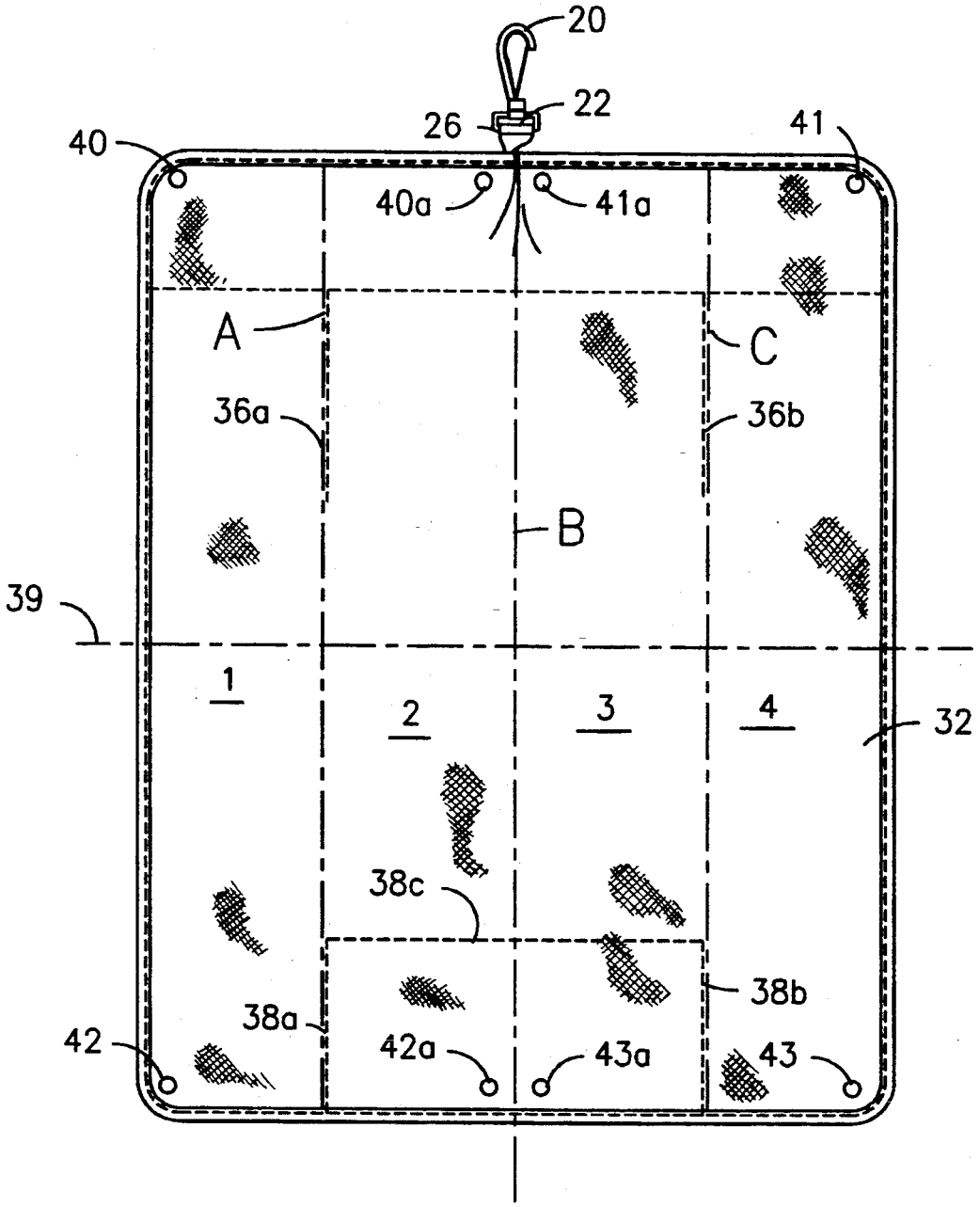
FIG. 5 is a front elevational view showing the device in its fully unfolded configuration, showing its water-repellant side.
Figure 6:
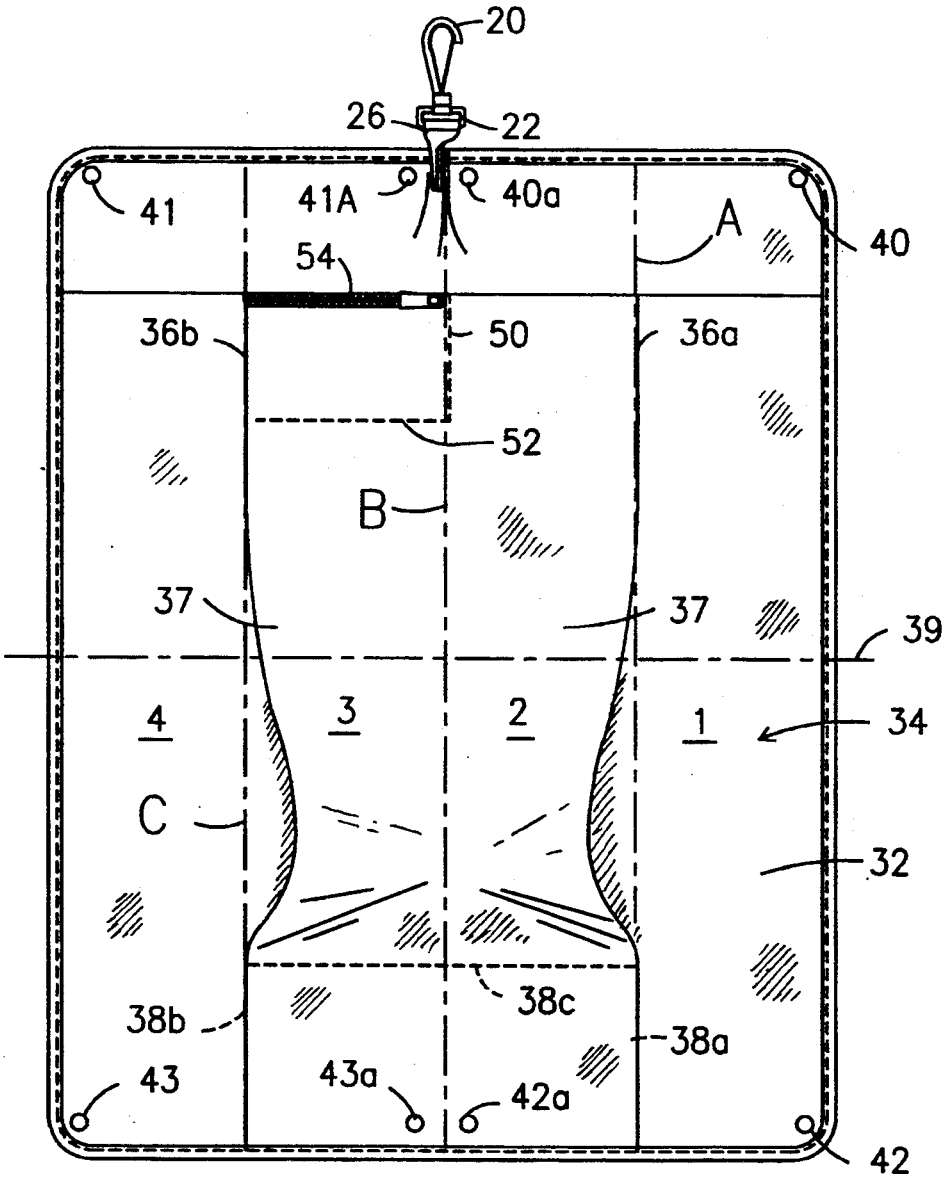
FIG. 6 is an elevational view of the device in its fully unfolded configuration, showing its towel side.

FIGS. 2–4 will be better understood if reference is first made to FIGS. 5 and 6. In FIG. 5, device 30 is shown in its completely unfolded configuration with its water repellant side 32 facing the viewer.

Three longitudinally extending, laterally spaced apart fold lines A, B, and C subdivide device 30 into four substantially equal sections as shown, which sections will be referred to as sections 1, 2, 3 and 4 as indicated.

FIG. 6 shows the towel side 34 of device 30; since FIG. 6 is a reverse view of member 30 relative to FIG. 5, sections 1, 2, 3, and 4 appear in reverse order, of course. Note that towel 36 is sewn to water-repellant material 32 along its laterally spaced apart edges 36*a*, 36*b*, 38*a*, 38*b*, stitching 36*a*, 36*b* being longitudinally spaced from stitching 38*a*, 38*b*, and that the medial part 37 of towel 36 is not attached to material 32 at any point therebetween. This enables the golfer to place his or her hands behind the towel for hand-drying in the usual fashion. Stitching 38*c* closes the area bounded by stitches 38*a*, 38*b* to prevent debris from collecting in the lower part of the device.

Snap-type buckles, or other suitable quick release fastening means, denoted 40, 41, 42, and 43, are positioned on the four corners of the water-repellant side 32, as shown in FIG. 5. They releasably engage their respective mating bases 40*a*, 41*a*, 42*a*, and 43*a* when the device is in its FIG. 1 configuration, as perhaps best understood in connection with FIG. 6 (flap 1 being folded behind flap 2, and flap 4 being folded behind flap 3).

The novel storage means is formed on the towel side 34. As shown in FIG. 6, it is defined by stitching 50, 52 and zipper 54. Thus, it is easily accessible when device 30 is in its FIG. 1 configuration.

Figure 7:
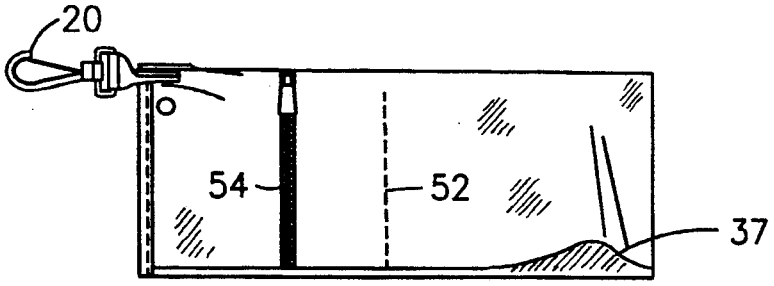
FIG. 7 is an elevational view of the device when fully folded for storage.

To store device 30 when not in use, another fold may be made along central folding line B, and a final fold may be made along the transverse axis 39. The fully folded configuration is depicted in FIG. 7.

This invention is clearly new and useful. Moreover, it was not obvious to those of ordinary skill in this art at the time it was made, in view of the prior art considered as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention which, as a matter of language, might be said to fall therebetween.

Now that the invention has been described,

What is claimed is:

1. An article of manufacture, comprising:

a first flat, flexible, foldable sheet material of predetermined configuration and dimension;

a second flat, flexible, foldable sheet material of predetermined configuration and dimension;

said first sheet material being being formed of a water-repellant material and defining a first side of said article;

said second sheet material defining a second side of said article and being formed of a water-absorbant material;

said second sheet of material being secured to said first sheet of material at a first plurality of preselected locations and being unsecured thereto at a second plurality of preselected locations;

a releasable clamp member being permanently secured to a preselected peripheral edge of said article to releasably secure the article to a golf bag;

three equidistantly spaced, longitudinally extending, parallel folding lines formed in said article so that said article is foldable, into four equi-sized longitudinal sections;

said folding lines including a first, a second, and a third folding line, said second folding line longitudinally bisecting said article of manufacture;

said first plurality of preselected locations being coincident with opposite ends of said first and third folding lines, said second sheet of material being unsecured to said first sheet of material intermediate said opposite ends to enable a user to place his or her hands on opposite sides of said second sheet of material intermediate said opposite ends.

2. The article of claim 1, further comprising a plurality of fastening members for holding said article when folded.

3. The article of claim 1, further comprising a storage means formed in said article on said second side.

4. The article of claim 3, wherein said storage means is a pocket formed by joining together said first and second sheets of material to one another along preselected joining lines thereby defining a storage space therebetween, said storage means further including closure means for selectively opening and closing said storage means.

* * * * *